US008303063B2

(12) United States Patent
Kubota et al.

(10) Patent No.: US 8,303,063 B2
(45) Date of Patent: Nov. 6, 2012

(54) PRINTING APPARATUS AND METHOD OF CONTROLLING PRINTING APPARATUS

(75) Inventors: Mai Kubota, Shiojiri (JP); Bunji Ishimoto, Matsumoto (JP); Akito Sato, Matsumoto (JP); Tomohiro Yuda, Minowa-machi (JP); Naoki Sudo, Matsumoto (JP); Takahide Miyashita, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 154 days.

(21) Appl. No.: 12/834,269

(22) Filed: Jul. 12, 2010

(65) Prior Publication Data

US 2011/0057972 A1 Mar. 10, 2011

(30) Foreign Application Priority Data

Sep. 10, 2009 (JP) ..... 2009-209745

(51) Int. Cl.
*B41J 29/38* (2006.01)

(52) U.S. Cl. ..... 347/9

(58) Field of Classification Search ..... None
See application file for complete search history.

(56) References Cited

U.S. PATENT DOCUMENTS

| | | | | |
|---|---|---|---|---|
| 6,336,705 | B1 | 1/2002 | Torigoe | |
| 6,547,352 | B1 * | 4/2003 | Ikeda | 347/11 |
| 2003/0081029 | A1 | 5/2003 | Underwood | |
| 2005/0200905 | A1 * | 9/2005 | Kimura | 358/3.27 |
| 2011/0063347 | A1 | 3/2011 | Kubota et al. | |

FOREIGN PATENT DOCUMENTS

| | | | |
|---|---|---|---|
| EP | 0925931 | A2 | 6/1999 |
| EP | 0935213 | A2 | 8/1999 |
| JP | 11-188896 | A | 7/1999 |
| JP | 2000-198227 | A | 7/2000 |
| JP | 2000-225719 | A | 8/2000 |
| JP | 2004-314534 | A | 11/2004 |
| JP | 2004-330624 | A | 11/2004 |
| JP | 2007-261205 | A | 10/2007 |

OTHER PUBLICATIONS

Office Action in U.S. App. No. 12/834,358 dated Apr. 30, 2012.
Extend European Search Report issued on Aug. 11, 2011 for Application No. 10187246.3.
Notice of Allowance in U.S. Appl. No. 12/834,269 dated Aug. 17, 2012.

* cited by examiner

*Primary Examiner* — Stephen Meier
*Assistant Examiner* — Tracey McMillion
(74) *Attorney, Agent, or Firm* — Nutter McClennen & Fish LLP; John J. Penny, Jr.; Christina M. Sperry

(57) ABSTRACT

A printing apparatus including a first nozzle that ejects dye ink; a second nozzle that ejects pigment ink of a color that is the same as the dye ink; and a controller that controls ejection of ink from the first nozzle and the second nozzle. The controller performs a first ejection operation, in which the pigment ink is ejected from the second nozzle after the dye ink is ejected from the first nozzle, for a predetermined position on a medium and performs a second ejection operation, in which the dye ink is ejected from the first nozzle after the pigment ink is ejected from the second nozzle, for a second position on the medium. An amount of the pigment ink per unit area that is ejected in the second ejection operation is made smaller than an amount of the pigment ink per the unit area in the first ejection operation.

7 Claims, 7 Drawing Sheets

| GRAYSCALE VALUE | DOT SIZE | SELECTION PULSE |
|---|---|---|
| 00 | NO DOT | VP1 |
| 01 | SMALL DOT | PS2 |
| 10 | MIDDLE DOT | PS1 |
| 11 | LARGE DOT | PS3 |

PRINTING APPARATUS AND METHOD OF CONTROLLING PRINTING APPARATUS

BACKGROUND

1. Technical Field

The present invention relates to a printing apparatus that includes a nozzle ejecting dye ink and a nozzle ejecting pigment ink of a color that is the same as the dye ink and a method of controlling a printing apparatus.

2. Related Art

As printing apparatuses having a nozzle that ejects dye ink and a nozzle that ejects pigment ink of a color that is the same as the dye ink, ink jet printing apparatuses that include nozzles for black dye ink, which is used for printing a high-quality color image on a dedicated sheet, and black pigment ink, which is used for clearly printing particularly texts and the like on a plain sheet are known (for example, see JP-A-2000-225719). Such ink jet printing apparatuses have a head in which a nozzle row for ejecting dye ink and a nozzle row for ejecting pigment ink are disposed so as to be aligned in the direction intersecting the transport direction of a medium. There are cases where printing is performed by using the dye ink and the pigment ink for a predetermined position on the medium while moving the head in the intersection direction.

However, although the dye ink and the pigment ink used in the above-described ink jet printing apparatus have the same black color, there are cases where the hues and the densities of the dye ink and the pigment ink are different from each other in correspondence with the medium for ejection. In addition, when an image is formed by ejecting the dye ink and the pigment ink while reciprocating the head in the intersection direction intersecting the transport direction of the medium, the order of ink ejected in a predetermined position on the medium is reversed between a forward path and a backward path of the head. In other words, for example, the pigment ink is ejected on the dye ink ejected on the medium in the forward path, and the dye ink is ejected on the pigment ink ejected on the medium in the backward path. When the order of ejected ink is reversed as described above, there are differences in the hues and the densities of a portion printed in the forward path and a portion printed in the backward path. Accordingly, there is a problem in that unevenness or a stripe pattern is generated in the image, whereby the image quality deteriorates.

SUMMARY

An advantage of some aspects of the invention is that it provides a printing apparatus capable of printing a high-quality image by using dye ink and pigment ink and a method of controlling a printing apparatus.

According to an aspect of the invention, there is provided a printing apparatus including: a first nozzle that ejects dye ink; a second nozzle that ejects pigment ink of a color that is the same as the dye ink; and a controller that controls ejection of ink from the first nozzle and the second nozzle. The controller performs a first ejection operation, in which the pigment ink is ejected from the second nozzle after the dye ink is ejected from the first nozzle, for a predetermined position on a medium and performs a second ejection operation, in which the dye ink is ejected from the first nozzle after the pigment ink is ejected from the second nozzle, for a position that is different from the predetermined position on the medium. An amount of the pigment ink per unit area that is ejected in the second ejection operation is made smaller than an amount of the pigment ink per the unit area in the first ejection operation.

Other aspects of the invention will be clarified by the description below and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Overview of Disclosure

Figure 1:
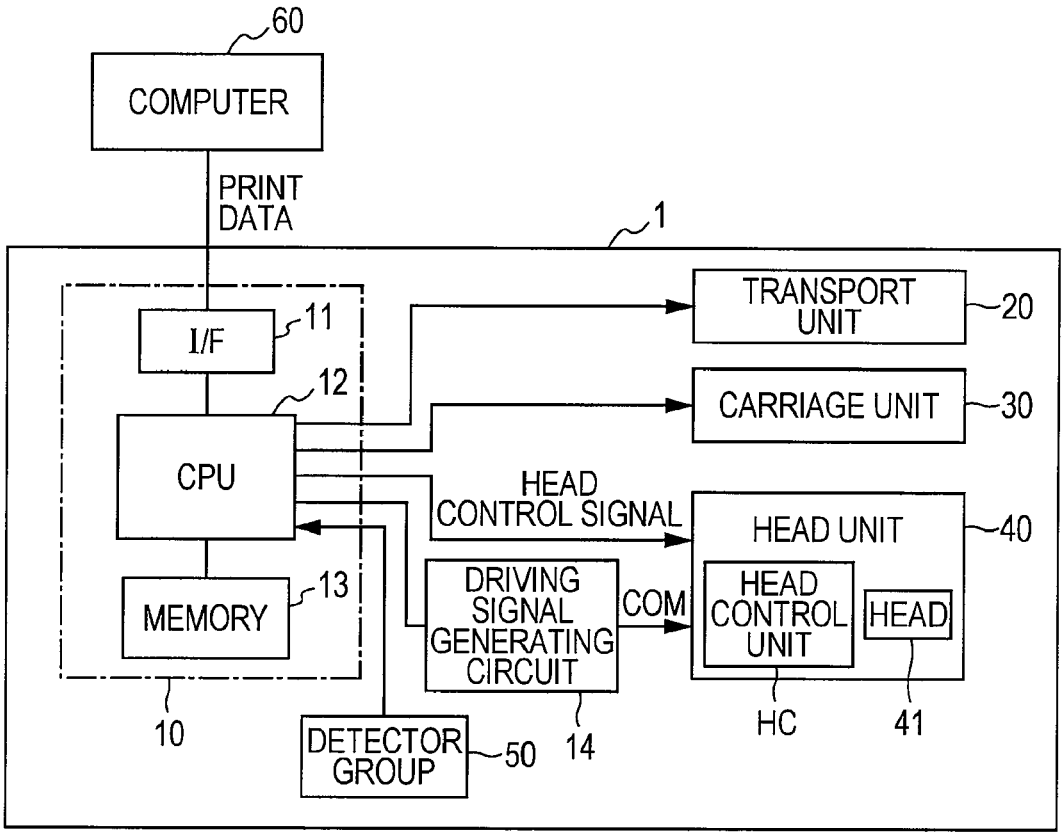
FIG. 1 is a block diagram of the entire configuration of a printer according to this embodiment.

At least the followings become apparent based on the description here and the accompanying drawings.

According to a first aspect of the invention, there is provided a printing apparatus including: a first nozzle that ejects dye ink; a second nozzle that ejects pigment ink of a color that is the same as the dye ink; and a controller that controls ejection of ink from the first nozzle and the second nozzle. The controller performs a first ejection operation, in which the pigment ink is ejected from the second nozzle after the dye ink is ejected from the first nozzle, for a predetermined position on a medium and performs a second ejection operation, in which the dye ink is ejected from the first nozzle after the pigment ink is ejected from the second nozzle, for a position that is different from the predetermined position on the medium. An amount of the pigment ink per unit area that is ejected in the second ejection operation is made smaller than an amount of the pigment ink per the unit area in the first ejection operation.

Even when the pigment ink and the dye ink have the same color, the hues thereof are different from each other, or the densities thereof are different from each other based on a difference in the order of ejection of the ink onto a medium for superimposition. In particular, in a case where the pigment ink is ejected after the dye ink is ejected, the hue inclines to the dye ink side, compared to a case where the dye ink is ejected after the pigment ink is ejected, whereby the density is viewed to be low. Accordingly, in the above-described printing apparatus, the amount of the pigment ink per unit area that is ejected in the second ejection operation is decreased to be smaller than the amount of pigment ink per the unit area that is ejected in the first ejection operation. Thus, the hue of an area that is printed in the first operation becomes close to the pigment ink side, and the density of the area becomes high. Accordingly, differences in the hues and the densities of the areas printed in the first ejection operation and the second ejection operation are decreased, whereby a high-quality image can be printed.

In the above-described printing apparatus, it is preferable that the amount of the pigment ink ejected in the second ejection operation is made smaller than the amount of the pigment ink ejected in the first ejection operation by decreasing the amount of the pigment ink ejected in the second ejection operation.

As methods of decreasing the amount of the pigment ink ejected in the second ejection operation to be smaller than that of the pigment ink ejected in the first ejection operation, there are a method of increasing the amount of the pigment ink ejected in the first ejection operation and a method of decreasing the amount of the pigment ink ejected in the second ejection operation. At this time, as the above-described printing apparatus, in a case where the method of decreasing the amount of the pigment ink ejected in the second ejection operation is used, by decreasing the amount of the pigment ink per unit area that is ejected in the second ejection operation to be smaller than that of the pigment ink per unit area that is ejected in the first ejection operation, the amount of the pigment ink per the unit area that is ejected in the second ejection operation can be decreased to be smaller than that of the pigment ink per the unit area that is ejected in the first ejection operation without increasing the number of times of ejection of ink and decreasing the transport amount of the medium. In such a case, the number of times of ejection of ink is not increased, and the transport amount of the medium is not decreased. Accordingly, a high-quality image can be printed without decreasing the printing speed.

In the above-described printing apparatus, it is preferable that the color of the dye ink and the pigment ink are black.

The dye ink has the characteristics that the transparency and the reproducibility of colors are high, and the pigment ink has such characteristics that texts and the like can be printed more clearly. Accordingly, by arranging the dye ink and the pigment ink of a black color that is the most frequently used for printing texts and ejecting the pigment ink of a smaller amount in the second ejection operation than in the first ejection operation, generation of a hue difference and a density difference is suppressed in a printing process using the dye ink and the pigment ink while clear printing of the texts is maintained by using the pigment ink. Therefore, an image having a high image quality can be printed.

It is preferable that the above-described printing apparatus further includes: a transport mechanism that transports the medium in a transport direction; a head in which the first nozzle and the second nozzle are disposed so as to be aligned in an intersection direction that intersects the transport direction; and a head moving mechanism that moves the head in two ways along the intersection direction, wherein the first ejection operation is performed by moving the head in one way of the two ways, and the second ejection operation is performed by moving the head in the other way of the two ways.

In such a printing apparatus, when ink is ejected by moving the head in which the first nozzle ejecting the dye ink and the second nozzle ejecting the pigment ink are disposed so as to be aligned in the intersection direction that intersects the transport direction is moved in two ways along the intersection direction, the order of ejected ink is different between movement in one way of the two ways and movement in the other way. Accordingly, by performing the first ejection operation at the time of movement of the head in one way and the second ejection operation at the time of movement of the head in the other way, generation of a hue difference and a density difference is suppressed while moving the head in two ways, whereby an image having a high image quality can be printed. Therefore, an image having a higher image quality can be printed at a higher speed.

In the above-described the printing apparatus, it is preferable that the head has a first nozzle row formed by a plurality of the first nozzles disposed in the transport direction at a predetermined pitch and a second nozzle row formed by a plurality of the second nozzles disposed in the transport direction at the predetermined pitch, and the nozzles of the first nozzle row are disposed in positions deviated from the nozzles of the second nozzle row by a half of the predetermined pitch in the transport direction.

According to such a printing apparatus, each nozzle of the first nozzle row and each nozzle of the second nozzle row, which eject ink of the same color, are disposed in positions that are deviated from each other by a half of each nozzle-row pitch in the transport direction. Accordingly, between dots formed by the first nozzles in the transport direction, dots that are formed by the second nozzles can be disposed. In addition, between dots formed by the second nozzles, dots that are formed by the first nozzles can be disposed. Therefore, compared to a printing apparatus that only includes the first nozzle row or the second nozzle row, an image having a high image quality can be printed in a short time.

According to a second aspect of the invention, there is provided a method of controlling a printing apparatus including: a first nozzle that ejects dye ink; a second nozzle that ejects pigment ink of a color that is the same as the dye ink; and a controller that controls ejection of ink from the first nozzle and the second nozzle. The method includes: performing a first ejection operation, in which the pigment ink is ejected from the second nozzle after the dye ink is ejected from the first nozzle, for a predetermined position on a medium; and performing a second operation, in which the dye ink is ejected from the first nozzle after the pigment ink of an amount smaller than an amount of ink per unit area that is ejected in the first ejection operation from the second nozzle is ejected, for a position that is different from the predetermined position on the medium.

Even when the pigment ink and the dye ink have the same color, the hues thereof are different from each other, or the densities thereof are different from each other based on a difference in the order of ejection of the ink onto a medium for superimposition. In particular, in a case where the pigment ink is ejected after the dye ink is ejected, the hue inclines to the dye ink side, compared to a case where the dye ink is ejected after the pigment ink is ejected, whereby the density is viewed to be low. Accordingly, in the above-described printing apparatus, the amount of the pigment ink per unit area that is ejected in the second ejection operation is controlled to be decreased to be smaller than the amount of pigment ink per the unit area that is ejected in the first ejection operation. Thus, the hue of an area that is printed in the first operation becomes close to the pigment ink side, and the density of the area becomes high. Accordingly, differences in the hues and the densities of the areas printed in the first ejection operation and the second ejection operation are decreased, whereby a high-quality image can be printed.

Hereinafter, a preferred embodiment of the invention will be described with reference to the accompanying drawings. In the embodiments described below, as a concrete preferred example of the invention, various limitations are applied. However, the scope of the invention is not limited to such embodiments unless described otherwise. Hereinafter, as a printing apparatus according to an embodiment of the invention, an ink jet printer (hereinafter, referred to as a printer) will be described as an example.

Configuration of Printer

Figure 2:
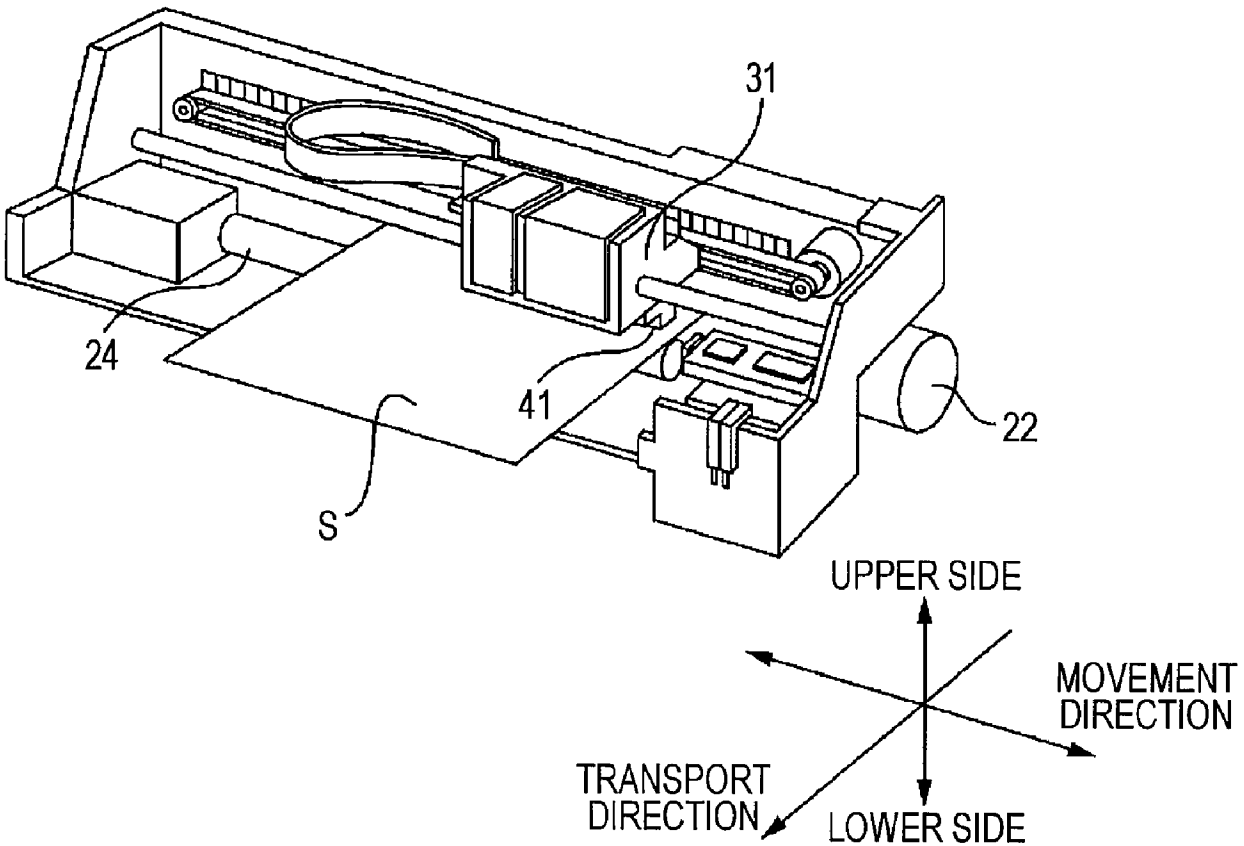
FIG. 2 is a perspective view of the printer.
Figure 3:
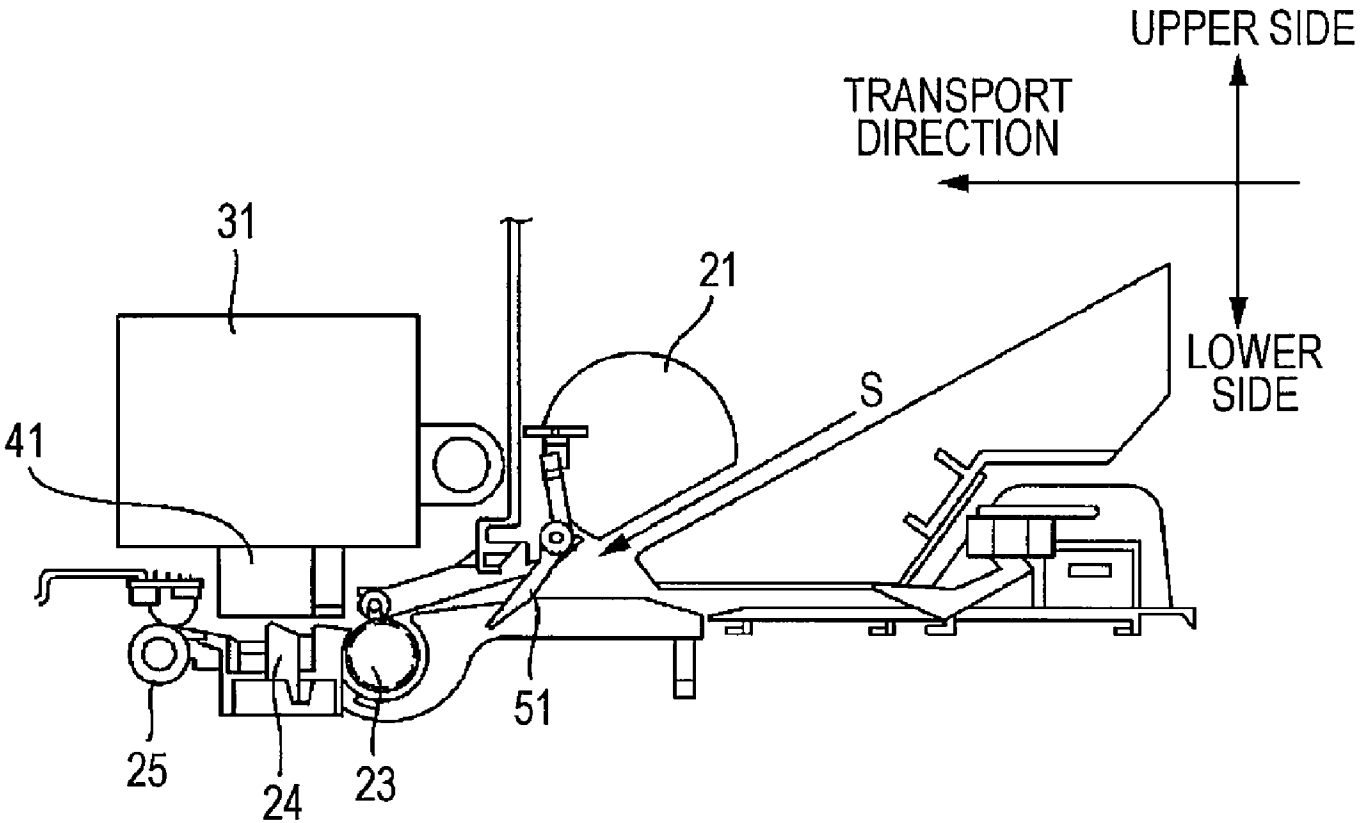
FIG. 3 is a cross-sectional view of the printer.

FIG. 1 is a block diagram of the entire configuration of a printer 1 according to this embodiment. FIG. 2 is a perspective view of the printer 1. FIG. 3 is a cross-sectional view of the printer 1. The printer 1 that receives print data from a computer 60 as an external apparatus forms an image on a paper sheet S (medium) by controlling each unit (a transport unit 20, a carriage unit 30, and a head unit 40) by using a controller 10. In addition, a detector group 50 monitors the internal state of the printer 1, and the controller 10 controls each unit based on the detection result.

The controller 10 is a control unit used for controlling the printer 1. An interface unit 11 is used for transmitting and receiving data between the computer 60 as an external apparatus and the printer 1. A memory 13 is used for securing an area for storing a program of a CPU 12, a work area, and the like. The CPU 12 controls each target control unit based on a computer program that is stored in the memory 13. For example, the CPU 12 controls the transport unit 20 or the carriage unit 30. In addition, the CPU 12 transmits a head control signal used for controlling the operation of the head 41 to a head control unit HC or transmits a control signal used for generating a driving signal COM to a driving signal generating circuit 14.

The transport unit 20 is used for feeding a paper sheet S in a printable position and then transporting the paper sheet S by a predetermined transport amount in the transport direction at the time of printing. The transport unit 20 includes a feed roller 21, a transport motor 22, a transport roller 23, a platen 24, and a discharge roller 25. By rotating the feed roller 21, a paper sheet S to be printed is transmitted to the transport roller 23. When a sheet detecting sensor 51 detects the position of the leading end of the paper sheet S transmitted from the feed roller 21, the controller 10 rotates the transport roller 23 and positions the paper sheet S at a print start position. When the paper sheet S is positioned at the print start position, at least a part of nozzles of the head 41 faces the paper sheet S. Here, the transport unit 20 corresponds to a transport mechanism.

The carriage unit 30 is used for moving the head 41 in an intersection direction (hereinafter, referred to as a movement direction) intersecting the transport direction. The printer 1 can eject ink from each nozzle in two ways in the movement direction. Here, the carriage unit 30 corresponds to a head moving mechanism.

The head unit 40 includes a head 41 that is used for ejecting ink onto a paper sheet S. On the lower face of the head 41, a plurality of nozzles serving as ink ejecting units is disposed. In each nozzle, an ink chamber (not shown) in which ink is housed and a driving device (piezo device) that is used for ejecting ink by changing the volume of the ink chamber are disposed.

Figure 4:
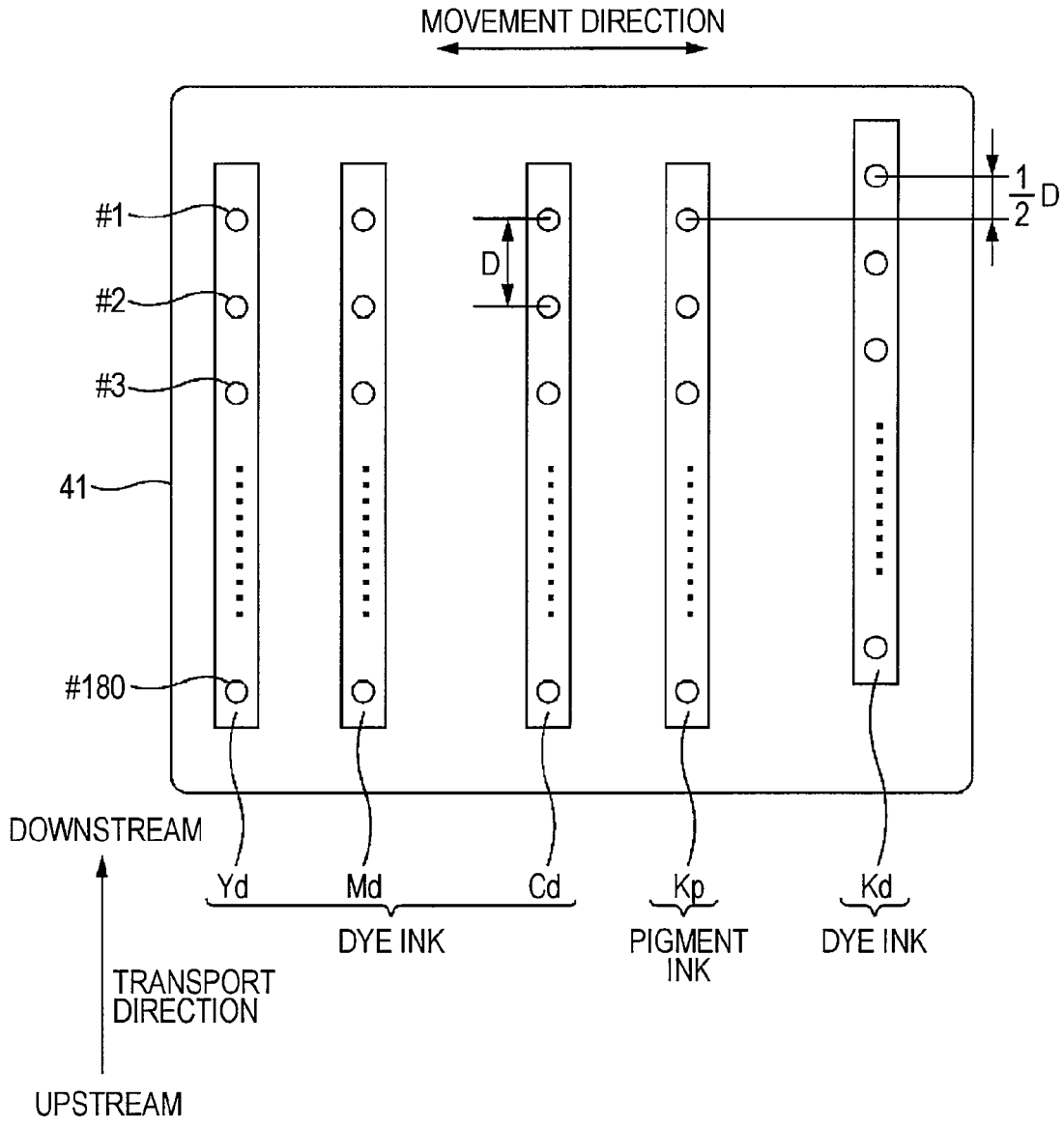
FIG. 4 is a schematic diagram illustrating the arrangement of nozzles on a lower face of a head.

FIG. 4 is a schematic diagram illustrating the arrangement of nozzles on the lower face (nozzle face) of the head 41. From the nozzles of the head 41 of the printer 1 according to this embodiment, black pigment ink, black dye ink, and color (cyan, magenta, and yellow) dye ink are ejected. Accordingly, on the lower face of the head 41, a dye black ink nozzle row Kd as a first nozzle row, a pigment black ink row Kp as a second nozzle row, a dye cyan ink nozzle row Cd, a dye magenta ink nozzle row Md, and a dye yellow dye ink nozzle row Yd are formed. Here, nozzles configuring the dye black ink nozzle row Kd correspond to first nozzles, and nozzles configuring the black pigment ink nozzle row Kp correspond to second nozzles.

Each nozzle row includes 180 nozzles. As a nozzle is located further on the downstream side, a smaller nozzle number is attached to the nozzle (#i=#1 to #180). In addition, the nozzles of each row are aligned along the transport direction (it corresponds to a predetermined direction) with a constant gap (pitch) D (for example, 180 dpi). In addition, the nozzles of four nozzle rows of the pigment black ink nozzle row Kp, the dye cyan ink nozzle row Cd, the dye magenta ink nozzle row Md, and the yellow dye ink nozzle row Yd that are disposed on the lower face of the head 41, which have the same number, are disposed such that nozzles of the same number are aligned in the movement direction. In addition, the nozzles of the dye black ink nozzle row Kd are disposed on the downstream side of the nozzles of the other four nozzle rows in the transport direction by a half a nozzle pitch D.

In such a serial-type printer 1, a dot forming process for forming dots on a paper sheet S by intermittently ejecting ink from the head 41 that moves along the movement direction and a transport process for transporting the paper sheet S in the transport direction are alternately repeated. Accordingly, dots are formed in positions different from a predetermined position in which a dot is formed by the previous dot forming process, whereby an image is formed.

The driving signal generating circuit 14 generates a driving signal COM based on DAC data. The DAC data is data that defines a change pattern in the electric potential of the generated driving signal COM. The DAC data is stored in the memory 13 and is read out so as to be output to the driving signal generating circuit 14 when the driving signal COM is generated. The head control unit HC selects a necessary portion of the driving signal COM generated by the driving signal generating circuit 14 based on a head control signal and applies the selected signal to the piezo device.

Figure 5:
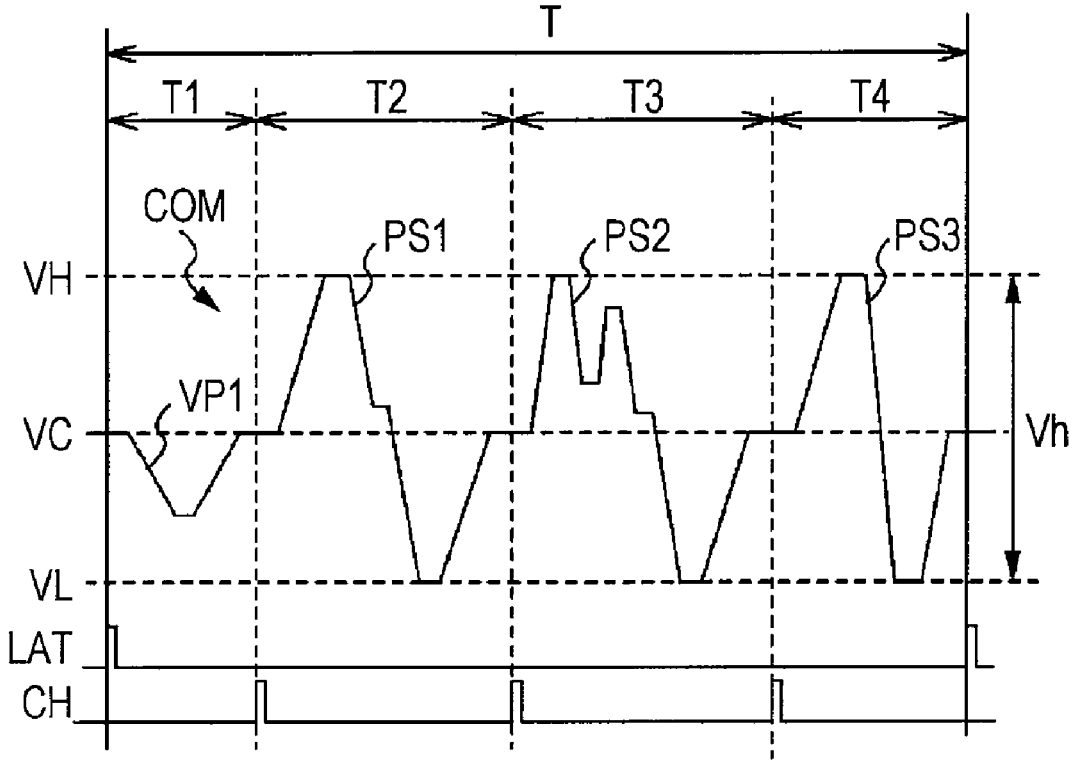
FIG. 5 is a diagram illustrating a driving signal that is generated by a driving signal generating circuit.

The driving signal COM generated by the driving signal generating circuit 14, for example, is as shown in FIG. 5. In FIG. 5, the horizontal axis represents the time, and the vertical axis represents the electric potential of a signal. This driving signal COM is repeatedly generated for each repetition cycle T. This repetition cycle T can be divided into four periods in correspondence with generated driving pulses. In other words, in a first period T1, a delicate vibration pulse VP is generated. In a second period T2, a middle dot pulse PS1 is generated. In addition, in a third period T3, a small dot pulse PS2 is generated. In a fourth period T4, a large dot pulse PS3 is generated. In addition, such periods are defined by a latch pulse included in a latch signal LAT or a change pulse included in a change signal CH.

The delicate vibration pulse VP is applied to the piezo device in the event that no ink droplet can be ejected. When the delicate vibration pulse VP is applied, the piezo device slightly expands or contracts and applies a slight change in the pressure to a degree to which no ink is ejected, to the ink stored in the pressure chamber. A meniscus (the free surface of ink that is exposed to the nozzle) slightly vibrates inside the nozzle in accordance with the change in the pressure. Accordingly, an increase in viscosity of ink is suppressed near the nozzle. The middle dot pulse PS1 is applied to the piezo device when a middle dot is formed on a paper sheet. Similarly, the small dot pulse PS2 is applied to the piezo device when a small dot is formed. In addition, a large dot pulse PS3 is applied to the piezo device when a large dot is formed.

Figures 6, 7:
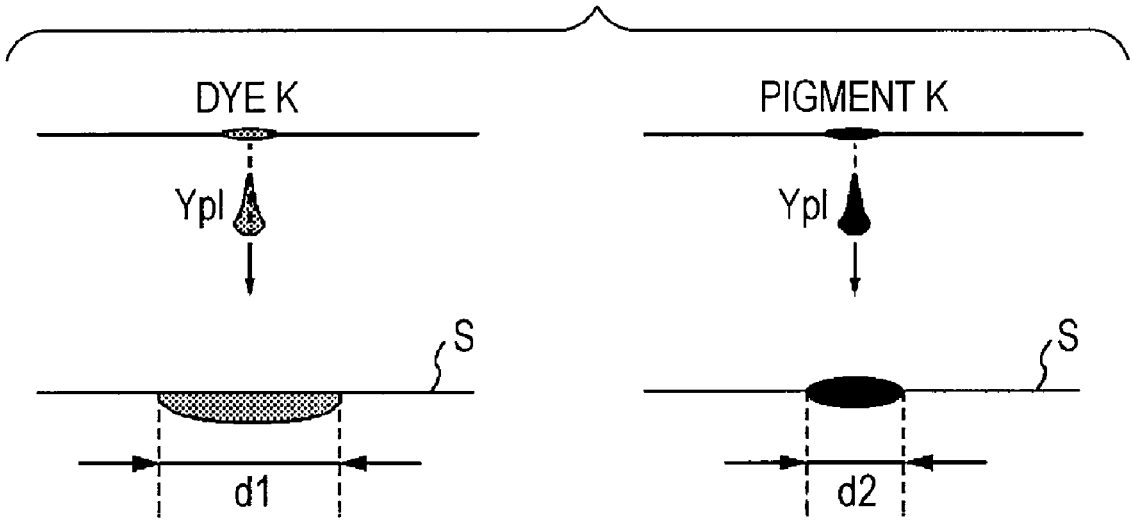
FIG. 6 is an image diagram of a correspondence data table of the dot grayscale value included in print data and the driving pulse.
FIG. 7 is a diagram representing a difference in the diameter of a dot of dye and the diameter of a dot of pigment.

As shown in FIG. 6, in the printer 1, a driving pulse (a delicate vibration pulse VP to a large dot pulse PS3) is selected in accordance with a dot grayscale value included in the print data and the selected driving pulse is applied to the piezo device. In other words, a delicate vibration pulse VP is applied to the piezo device in accordance with a dot grayscale value [00] representing no dot formation, and a small dot pulse PS2 is applied to the piezo device in accordance with a dot grayscale value [01] representing small dot formation. In addition, a middle dot pulse PS1 is applied to the piezo device 431 in accordance with a dot grayscale value [10] representing middle dot formation, and a large dot pulse PS3 is applied to the piezo device in accordance with a dot grayscale value [11] representing large dot formation.

The printer 1 of this embodiment ejects pigment ink and dye ink for black. It is more difficult to permeate the pigment ink than the dye ink. In addition, the pigment ink has water resistance and weather resistance that are superior to those of the dye ink. However, pigment components of the pigment ink that are coloring materials remain on a paper sheet, so that surface unevenness is formed. Accordingly, the gloss of the pigment ink is difficult to be implemented. On the other hand, the dye ink is more permeable than the pigment ink, and accordingly, the gloss can be easily implemented. However, the dye ink has water resistance and weather resistance that are inferior to those of the pigment ink. In addition, although the dye ink and the pigment ink have the same black color, the hues thereof are different from each other. The black dye ink has a hue inclining to the cyan side, and the black pigment ink has a hue inclining to the magenta side.

In addition, the pigment black ink (hereinafter, referred to as pigment K) can express a high density of black, compared to the dye black ink (hereinafter, referred to as dye K). Accordingly, for example, in a case where a monochrome text document is printed with "pigment K", the image quality of a black character can be improved. On the other hand, in a case where a color photograph image is printed with "dye YMCK", an image having gloss can be acquired.

FIG. 7 is a diagram representing a difference in the diameter of a dot of dye K and the diameter of a dot of pigment K. When the same amount (Ypl) of ink is ejected from a nozzle, as shown in FIG. 7, the diameter (d1) of a dot of dye K is larger than the diameter d2 of a dot of pigment K. The reason for this is thought to be the permeation of dye K into the surface of a paper sheet S when being permeated to the paper sheet S.

However, in the printer 1, as described above, the nozzle row Kp of pigment K in which nozzles ejecting pigment K are aligned in the transport direction and the nozzle row Kd of dye K in which nozzles ejecting dye K are aligned in the transport direction are disposed in the movement direction of the carriage 31 with a large gap interposed therebetween. Accordingly, in a case where an image is printed by using pigment K and dye ink K while moving the carriage 31 in two ways in the movement direction, the order of ink ejected at the time of movement in one way of the two ways is opposite to that of ink ejected at the time of movement in the other way.

In particular, when a first ejection operation (hereinafter, referred to as a forward path operation) is performed in which ink is ejected to a predetermined position on the paper sheet S while the carriage 31 is moved with the side of the nozzle row Kd of dye K leading in FIG. 4, dye K is ejected first, and then, pigment K is ejected. On the other hand, when a second ejection operation (hereinafter, referred to as a backward path operation) is performed in which ink is ejected to a predetermined position on the paper sheet S while the carriage 31 is moved with the side of the nozzle row Yd of yellow ink leading, pigment K is ejected first, and then, dye K is ejected.

As described above, the same black is printed in a portion in which pigment K is ejected after dye K is ejected first and a portion in which dye K is ejected after pigment K is ejected first. However, the hues and the densities of the above-described portions are different from each other. In particular, the portion in which pigment K is ejected after dye K is ejected first has a hue inclining to the dye K side and has a low density. On the other hand, the portion in which dye K is ejected after pigment K is ejected first has a hue inclining to the pigment K side and has a high density. For example, when it is set, in correspondence with the type of a paper sheet, such that the hue of dye K inclines to a cyan system, and the hue of pigment K inclines to a magenta system, black inclining to the cyan system is printed in the portion in which pigment K is ejected after dye K is ejected first. On the other hand, in the portion in which dye K is ejected after the pigment K is ejected first, black inclining to the magenta system is printed. The reason for this is that, when pigment K is ejected first onto a paper sheet S, pigment K stays in position. On the other hand, when dye K is ejected first, pigment K permeates or diffuses into the paper sheet S together with dye K. Accordingly, it is thought that the hue inclines to the dye K side, and the density is lowered.

Accordingly, in the printer 1, when printing is performed by using dye ink and pigment ink while the carriage 31 is moved in two ways in the movement direction, the ink amount of pigment K per unit area, which is ejected to a predetermined position on the paper sheet S so as to eject dye K before pigment K while the carriage 31 is moved, is decreased to be smaller than the ink amount of pigment K per the unit area that is ejected to a predetermined position on the paper sheet S so as to eject pigment K before dye K while the carriage 31 is moved.

The operation at the time when printing is performed by using dye K and pigment K while the carriage 31 moves in two ways in the movement direction will be described. Here, an example in which the printer 1 receives a printing direction signal, which is used for printing an image having an entirely black face, that is, a so-called beta image at a high speed by forming raster lines (lines formed by dots connected in the movement direction) with a pitch that is a half of the nozzle pitch D, from the computer 60 together with the image data will be described.

Here, the printer 1 can print the image only by using pigment K or dye K. However, when the image is printed only by using pigment K or dye K, a so-called pseudo band printing process, in which printing is performed by repeating transport corresponding to the length of the nozzle row and transport for a distance that is a half of the nozzle pitch D in the transport direction, is performed. In addition, in order to print the above-described beta image having the entire face being filled with black dots, ink is ejected for forming all the large dots.

However, in the printer 1, the nozzle row Kd of dye K and the nozzle row Kp of pigment K are disposed to be deviated from each other by a half of the nozzle pitch D in the transport direction. Accordingly, by printing by using dye K and pigment K, in so-called band printing in which printing is performed only by repeating transport corresponding to the length of the nozzle row without transport for the distance that is half the nozzle pitch D, printing can be performed so as to form the raster lines at a pitch that is a half of the nozzle pitch.

Accordingly, the print direction signal and the image data that are received by the printer 1 from the computer 60 are a print direction signal and image data that are used for printing a black beta image in a two-way printing process using the dye K and the pigment K, by using a printer driver of the computer 60.

Then, the controller 10 of the printer 1 transmits a signal to the driving signal generating circuit 14 based on the received print direction signal and image data, which is for generating a driving signal COM that is used for ejecting ink for forming all the large dots with dye K and pigment K in a case where the movement direction of the carriage 31 is the direction in which the carriage 31 is moved with the dye K nozzle row Kd side, shown in FIG. 4, in the lead and for ejecting ink for forming all the large dots with dye K and forming all the middle dots with pigment K in a case where the movement direction of the carriage 31 is the direction in which the carriage 31 is moved with the yellow ink nozzle row Yd side, shown in FIG. 4, in the lead.

Figure 8:
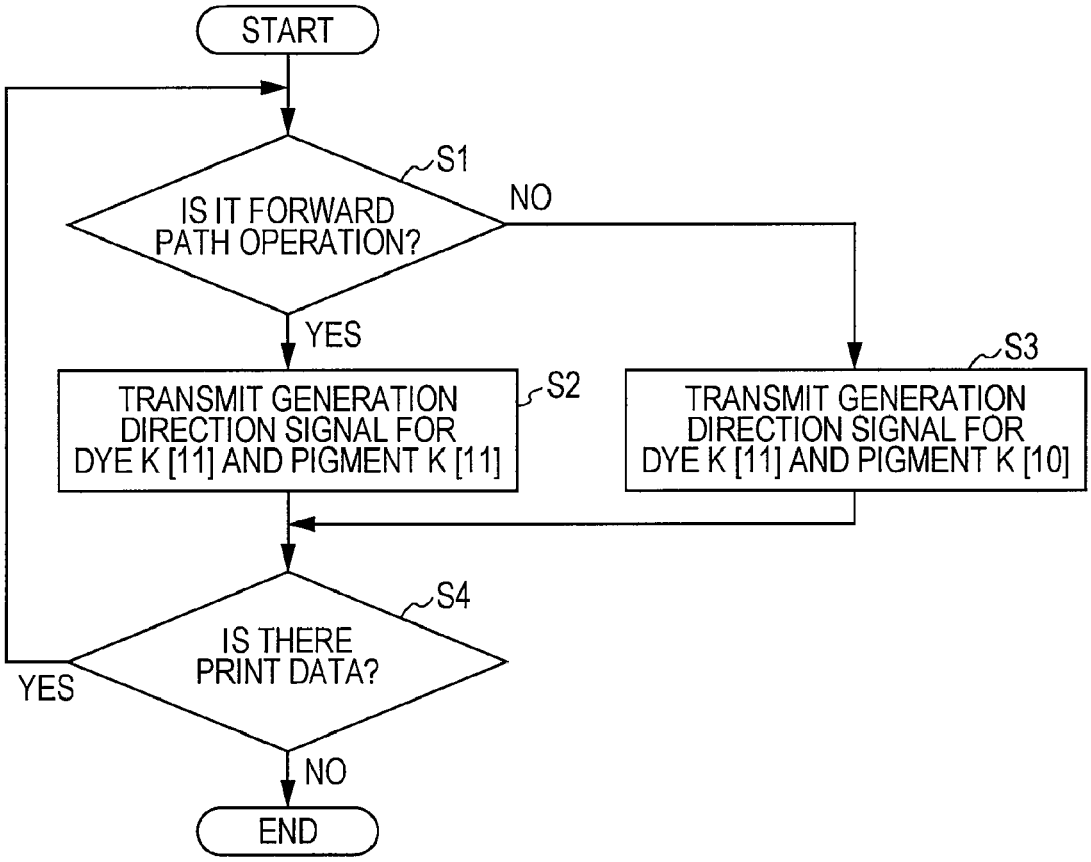
FIG. 8 is a diagram illustrating control performed by a controller on the printer side.

In other words, when receiving a printing direction signal for performing two-way printing by using dye K and pigment K, the controller 10 determines the movement direction of the carriage 31 based on the received direction signal as shown in FIG. 8. At this time, when a forward path operation, that is, a printing operation in which pigment K is ejected after dye K is ejected in a predetermined position on a paper sheet S is determined (S1), the controller 10 transmits a signal to the driving signal generating circuit 14 for generating a driving signal COM corresponding to the dot grayscale value [11] representing formation of large dots with both the dye K nozzle row Kd and the pigment K nozzle row Kp (S2). On the other hand, when a backward direction, that is, a printing operation in which dye K is ejected after pigment K is ejected in a predetermined position on a paper sheet S is determined (S1), the controller 10 transmits a signal to the driving signal generating circuit 14 for generating a driving signal COM corresponding to the dot grayscale value [11] representing formation of large dots for the dye K nozzle row Kd and generating a driving signal COM corresponding to the dot grayscale value [10] representing formation of middle dots for the pigment K nozzle row Kp (S3).

Then, a large dot pulse PS3 or a middle dot pulse PS1 is applied to the piezo device based on the driving signal COM that is transmitted from the driving signal generating circuit 14.

According to the printer 1 of this embodiment, the ink amount of pigment K per unit area that is ejected in the backward path operation in which dye K is ejected after pigment K is ejected is made smaller than that of pigment K that is ejected in the forward path operation in which pigment K is ejected after dye K is ejected. Accordingly, the hue of an area printed in the forward path operation becomes close to pigment K side, and the density thereof increases. Therefore, differences in hues and densities of areas printed in the forward path operation and the backward path operation are decreased, whereby a higher quality image can be printed.

As a method of decreasing the ink amount of pigment K per unit area that is ejected in the backward path operation to be smaller than that of pigment K per unit area that is ejected in the forward path operation, there are a method of increasing the amount of pigment K that is ejected in the forward path operation and a method of decreasing the amount of pigment K that is ejected in the backward path operation. At this time, similarly to the printer 1 of this embodiment, by decreasing the ink amount of pigment K per unit area that is ejected in the backward path operation to be smaller than that of pigment K per unit area that is ejected in the forward path operation by using the method of decreasing the amount of pigment K that is ejected in the backward path operation, it is possible to decrease the ink amount of the pigment ink per unit area that is ejected in the backward path operation to be smaller than that of pigment K per unit area that is ejected in the forward path operation without increasing the number of times of ejecting ink and decreasing the transport amount of a paper sheet S. Accordingly, an image having a higher image quality can be printed without decreasing the printing speed.

In addition, the dye ink has characteristics that the transparency and the reproducibility of colors are high, and the pigment ink has such characteristics that texts and the like can be printed more clearly. Accordingly, by arranging dye ink and pigment ink of a black color that is the most frequently used for printing texts and ejecting pigment K of a smaller amount in the backward path operation than in the forward path operation, texts are clearly printed, and generation of a hue difference and a density difference is suppressed in a printing process using the dye ink and the pigment ink. Therefore, an image having a high image quality can be printed. Accordingly, this embodiment is particularly effective for a printer 1 including black dye ink and black pigment ink.

In addition, each nozzle of the dye K nozzle row Kd and each nozzle of the pigment K nozzle row Kp, which eject ink of the same black color, are disposed in positions that are deviated from each other by a half of each nozzle pitch D in the transport direction. Accordingly, between dots formed by nozzles that eject dye K in the transport direction, dots that are formed by nozzles ejecting pigment K can be disposed. Therefore, compared to a printer that only includes a dye K nozzle row Kd or a pigment K nozzle row Kp, an image having a high image quality can be printed in a short time.

In the above-described embodiment, an example in which the ejection amounts of pigment K and dye K per unit area are changed by changing the size of dots from large to middle has been described. However, the size of dots that are formed with ink ejecting from nozzles on the side for decreasing the ejection amount may be small. In addition, an example in which the ejection amounts of pigment K and dye K per unit area are changed by changing the size of dots has been described. However, the invention is not limited thereto. For example, a pulse applied to the piezo device may be changed. In other words, the ink amount of pigment K per unit area that is ejected when dye K is ejected after the ejection of pigment K may be decreased to be smaller than the ink amount of pigment K per unit area that is ejected when pigment K is ejected after the ejection of dye K, so that a hue difference and a density difference between the area printed by ejecting dye K after earlier ejection of pigment K and the area printed by ejecting pigment K after earlier ejection of dye K decrease.

The invention is not limited to a printer and can be applied to various ink jet printing apparatuses such as a plotter, a facsimile apparatus or a copier as long as they are printing apparatuses that can perform printing by using dye ink and pigment ink.

The entire disclosure of Japanese Patent Application No. 2009-209745, filed Sep. 10, 2009 is expressly incorporated by reference herein.

What is claimed is:

1. A printing apparatus comprising:

a first nozzle that ejects dye ink;

a second nozzle that ejects pigment ink of a color that is the same as the dye ink; and a controller that controls ejection of ink from the first nozzle and the second nozzle, wherein the controller performs a first ejection operation, in which the pigment ink is ejected from the second nozzle after the dye ink is ejected from the first nozzle, for a predetermined position on a medium and performs a second ejection operation, in which the dye ink is ejected from the first nozzle after the pigment ink is ejected from the second nozzle, for a position that is different from the predetermined position on the medium, and wherein an amount of the pigment ink per unit area that is ejected in the second ejection operation is made smaller than an amount of the pigment ink per the unit area in the first ejection operation.

2. The printing apparatus according to claim 1, wherein the amount of the pigment ink ejected in the second ejection operation is made smaller than the amount of the pigment ink ejected in the first ejection operation by decreasing the amount of the pigment ink ejected in the second ejection operation.

3. The printing apparatus according to claim 1, wherein the color of the dye ink and the pigment ink is black.

4. The printing apparatus according to claim 1, further comprising:

a transport mechanism that transports the medium in a transport direction;

a head in which the first nozzle and the second nozzle are disposed so as to be aligned in an intersection direction that intersects the transport direction; and a head moving mechanism that moves the head in two ways along the intersection direction, wherein the first ejection operation is performed by moving the head in one way of the two ways, and the second ejection operation is performed by moving the head in the other way of the two ways.

5. The printing apparatus according to claim 1, wherein the head has a first nozzle row formed by a plurality of the first nozzles disposed in the transport direction at a predetermined pitch and a second nozzle row formed by a plurality of the second nozzles disposed in the transport direction at the predetermined pitch, and wherein the nozzles of the first nozzle row are disposed in positions deviated from the nozzles of the second nozzle row by a half of the predetermined pitch in the transport direction.

6. The printing apparatus according to claim 1, further comprising:

a transport mechanism that transports the medium in the transport direction;

a head in which the first nozzle and the second nozzle are disposed so as to be aligned in an intersection direction intersecting the transport direction; and a head moving mechanism that moves the head in two ways along the intersection direction, wherein the head has:

a first nozzle row that is formed by a plurality of the first nozzles disposed in the transport direction at a predetermined pitch; and a second nozzle row that is formed by a plurality of the second nozzles disposed in the transport direction at the predetermined pitch, wherein the nozzles of the first nozzle row are disposed in positions deviated from the nozzles of the second nozzle row by a half of the predetermined pitch in the transport direction, wherein the first ejection operation is performed by moving the head moves in one way of the two ways, and the second ejection operation is performed by moving the head in the other way of the two ways, wherein the amount of the pigment ink ejected in the second operation is made smaller than the amount of the pigment ink ejected in the first ejection operation by decreasing the amount of the pigment ink ejected in the second ejection operation, and wherein the dye ink and the pigment ink are black.

7. A method of controlling a printing apparatus comprising:

a first nozzle that ejects dye ink;

a second nozzle that ejects pigment ink of a color that is the same as the dye ink; and a controller that controls ejection of ink from the first nozzle and the second nozzle, the method comprising:

performing a first ejection operation, in which the pigment ink is ejected from the second nozzle after the dye ink is ejected from the first nozzle, for a predetermined position on a medium; and performing a second operation, in which the dye ink is ejected from the first nozzle after the pigment ink of an amount smaller than an amount of ink per unit area that is ejected in the first ejection operation from the second nozzle is ejected, for a position that is different from the predetermined position on the medium.

* * * * *